US010064440B2

(12) United States Patent
Levine

(10) Patent No.: US 10,064,440 B2
(45) Date of Patent: Sep. 4, 2018

(54) MEDICAL GOWN

(71) Applicant: Ian Levine, Cote St Luc (CA)

(72) Inventor: Ian Levine, Cote St Luc (CA)

( * ) Notice: Subject to any disclaimer, the term of this patent is extended or adjusted under 35 U.S.C. 154(b) by 104 days.

(21) Appl. No.: 14/085,023

(22) Filed: Nov. 20, 2013

(65) Prior Publication Data

US 2015/0135397 A1 May 21, 2015

(51) Int. Cl.
*A41D 13/12* (2006.01)

(52) U.S. Cl.
CPC ..... *A41D 13/1236* (2013.01); *A41D 13/129* (2013.01); *A41D 13/1209* (2013.01)

(58) Field of Classification Search
CPC ..... A41D 13/1236; A41D 13/1209; A41D 13/129; A41D 13/1245; A41D 13/0015; A41D 13/02; A41D 13/06; A41D 2200/10; A41D 3/00; A41D 3/02; A41D 3/04; A41D 3/08; A41D 15/00; A41D 15/04; A41D 1/02; A41D 27/10; A41D 27/04; A41D 27/06
USPC ..... 2/114, 85, 88, 93, 69, 69.5, 311, 312
See application file for complete search history.

(56) References Cited

U.S. PATENT DOCUMENTS 39,600 A * 8/1863 Westcott ..... 2/114
587,910 A * 8/1897 Arnold ..... A41D 13/1236 2/114
895,510 A * 8/1908 Snellenburg ..... A41D 13/1236 2/114
2,069,579 A * 2/1937 Epstein ..... A41D 1/02 2/128
2,127,763 A * 8/1938 Bentz ..... A41D 3/02 2/217
2,319,089 A * 5/1943 Severance ..... A41D 13/1236 2/114
2,657,389 A * 11/1953 Gross ..... A41D 3/08 2/88
2,707,282 A * 5/1955 Paterson ..... A41D 13/1236 2/114
2,846,686 A * 8/1958 Tames ..... A41D 13/1209 2/114
3,011,172 A * 12/1961 Tames ..... A41D 13/008 139/425 R (Continued)

FOREIGN PATENT DOCUMENTS

| | | |
|---|---|---|
| CA | 27999116 A1 | 8/2013 |
| EP | 2622975 A1 | 8/2013 |
| JP | 3182677 U | 4/2013 |

OTHER PUBLICATIONS

U.S. Appl. No. 29/473,224 for Medical Gown filed Nov. 20, 2013, inventor is Ian Levine.

(Continued)

*Primary Examiner* — Anna Kinsaul
*Assistant Examiner* — James Heracklis
(74) *Attorney, Agent, or Firm* — Donald J. Ranft; Collen

(57) ABSTRACT

A gown with an opening to allow passage the user's head allowing the gown to rest on the user's shoulders and an opening in the back with one cord attached to the inside of each side of the opening in the back of the gown and each cord then extends toward the shoulder area where each cord is temporarily attached and the cord further extends toward a hole in the opposite side of the opening in the back where it passes through a hole to the outer portion of the gown.

23 Claims, 7 Drawing Sheets

(56) References Cited

U.S. PATENT DOCUMENTS 3,042,931 A * 7/1962 Sawyer ..... A41D 3/08 2/84
3,218,649 A * 11/1965 Ricter ..... A41D 13/1209 2/114
3,353,189 A * 11/1967 Zimmon ..... A41D 13/1236 2/114
3,397,406 A * 8/1968 Leach ..... A41D 13/1236 2/111
3,470,568 A * 10/1969 Belkin ..... A41D 13/1209 2/114
3,729,747 A * 5/1973 Belkin ..... A41D 13/1209 2/114
3,748,659 A * 7/1973 Meyers ..... A41D 13/1209 2/114
3,977,025 A * 8/1976 Horan ..... A41D 13/1209 2/114
4,019,207 A * 4/1977 Newman ..... A41D 13/1209 2/51
4,026,282 A * 5/1977 Thomas ..... A61F 5/3784 128/873
4,106,120 A * 8/1978 Zurbrigg ..... A41D 13/1209 2/51
4,119,095 A * 10/1978 Lewis ..... A61F 5/3723 128/874
4,215,434 A * 8/1980 Barron ..... A41D 13/1236 2/114
4,290,148 A * 9/1981 Roberts ..... A41D 13/1209 2/51
4,384,370 A * 5/1983 Singer ..... A41D 13/1209 2/114
4,458,365 A * 7/1984 Wood ..... A41D 1/205 2/104
4,524,463 A * 6/1985 Ogden ..... A41F 9/025 2/105
4,622,699 A * 11/1986 Spriggs ..... A41D 13/1236 2/114
4,637,075 A * 1/1987 Ingrisano ..... A41D 13/0012 2/102
4,683,594 A * 8/1987 Feinberg ..... A41D 13/1236 2/105
4,853,977 A * 8/1989 Foreman ..... A41D 13/1263 2/114
5,062,159 A * 11/1991 Jakub ..... A41D 13/1236 2/105
5,267,352 A * 12/1993 Rodarmel ..... A41D 13/1245 128/846
5,361,414 A * 11/1994 Smith ..... A41D 13/1236 2/105
5,410,758 A * 5/1995 Dupont ..... A41D 13/1209 2/247
5,414,867 A * 5/1995 Bowling ..... A41D 13/1209 2/114
5,604,963 A * 2/1997 Akeno ..... A44B 18/0061 24/442
5,826,274 A * 10/1998 Thompson ..... A41D 13/012 2/2.15
6,012,166 A * 1/2000 Burbidge ..... A41D 13/1236 2/114
D422,396 S * 4/2000 Weir ..... D2/720
6,054,091 A * 4/2000 Miller ..... A44B 18/0049 24/452
6,115,839 A * 9/2000 Covington ..... A41D 13/1209 2/114
6,499,143 B2 * 12/2002 Garza ..... A41D 13/1236 2/114
6,694,521 B1 * 2/2004 Hopkins ..... A41B 13/08 2/114
7,162,780 B2 * 1/2007 Martin ..... A44B 18/0061 24/306
7,412,728 B2 * 8/2008 Alesina ..... A41D 27/28 2/69
8,332,965 B1 * 12/2012 Ryer ..... A41D 13/1236 2/114
8,701,215 B2 4/2014 Levine
8,821,461 B2 * 9/2014 Kovensky ..... A41D 13/1281 2/104
8,990,966 B2 * 3/2015 Von Furstenberg ..... A41D 13/1236 2/114
D785,284 S * 5/2017 Pasko ..... D2/720
2001/0034891 A1 * 11/2001 Matsushita ..... A41D 13/1209 2/141.1
2003/0074711 A1 * 4/2003 Iversen ..... A61H 7/001 2/69
2004/0098782 A1 * 5/2004 Griesbach, III ... A41D 13/1209 2/51
2007/0083976 A1 * 4/2007 Roy ..... A41D 13/1236 2/114
2008/0000006 A1 * 1/2008 Ochoa ..... A41D 13/1236 2/114
2009/0083895 A1 * 4/2009 Pellegrini ..... A41C 3/04 2/83
2009/0094729 A1 * 4/2009 Lin ..... A41D 13/1209 2/114
2010/0064414 A1 * 3/2010 Kemper ..... A41F 9/002 2/114
2010/0095424 A1 * 4/2010 Grgich ..... A41D 1/205 2/104
2010/0299805 A1 * 12/2010 Graneto, III ..... A41D 13/1209 2/114
2011/0024485 A1 * 2/2011 Porowski ..... A41D 13/1209 229/87.16
2011/0131701 A1 * 6/2011 Pryne ..... A41D 13/1245 2/114
2011/0154554 A1 * 6/2011 Furlong ..... A41D 13/1209 2/114
2011/0231981 A1 * 9/2011 Appel ..... A41D 13/1245 2/114
2011/0247122 A1 * 10/2011 Burke ..... A41D 13/1245 2/114
2012/0060257 A1 * 3/2012 Herzog ..... A41D 13/1236 2/114
2012/0159693 A1 * 6/2012 Takahashi ..... A41D 1/22 2/74
2013/0036526 A1 * 2/2013 Rashman ..... A41D 13/1245 2/114
2013/0133125 A1 * 5/2013 Mungaray ..... A41D 13/1245 2/114
2013/0198930 A1 * 8/2013 Levine ..... A41F 1/00 2/114
2014/0007316 A1 * 1/2014 Tommarello ..... A41D 13/1236 2/114

OTHER PUBLICATIONS

Extended European Search Report dated Mar. 27, 2015 for Application No. EP14179179.8-1705.
Jun. 15, 2015 Summary of Relevance for Japanese utiliy model registration No. 3,182,677 as cited as a foreign patent document in this Information Disclosure Statement.

* cited by examiner

MEDICAL GOWN

BACKGROUND

Many types of gowns used in medical procedures by patients, visitors, and medical personnel exist. Both disposable and reusable gowns are utilized. It is important that they can easily be put on and secured by the user. Securing the gown so that it does not fall off is critical. Various means are used such as ties, belts, buttons, hooks and loops, and snaps. Current gowns use a waist tie or belt that require the user to either tie the belt behind their back or reach around their back to tie the belt. As a result, improper gown use is common because many users have difficulty passing the belt around their backs or reaching behind their back to tie it. In many situations medical personnel cannot have anything on the front of the gown including the joining of straps securing the gown.

SUMMARY

A gown which can be pulled over the user's head and then secured by easily reaching straps/cords which are pulled and secured together to secure the gown.

DETAILED DESCRIPTION

Figure 1:
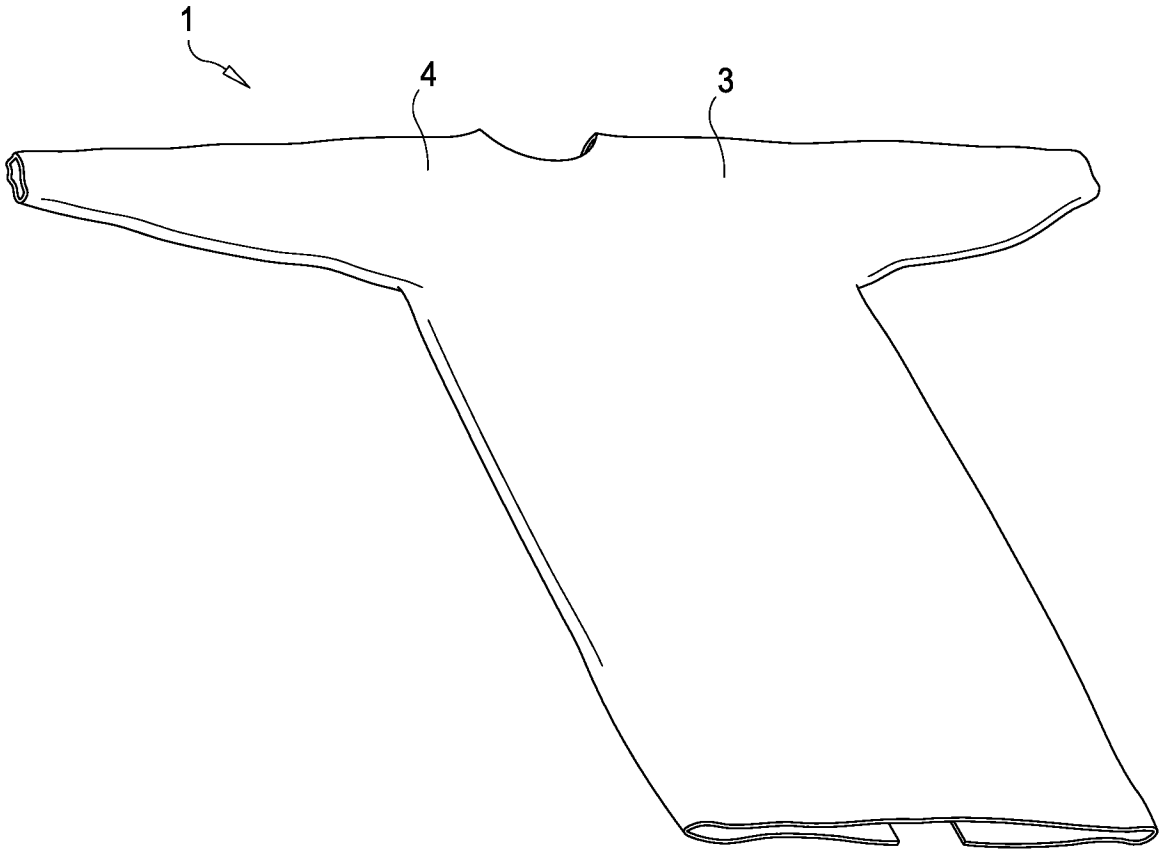
FIG. 1 is a perspective view of the front of the gown.
Figure 2:
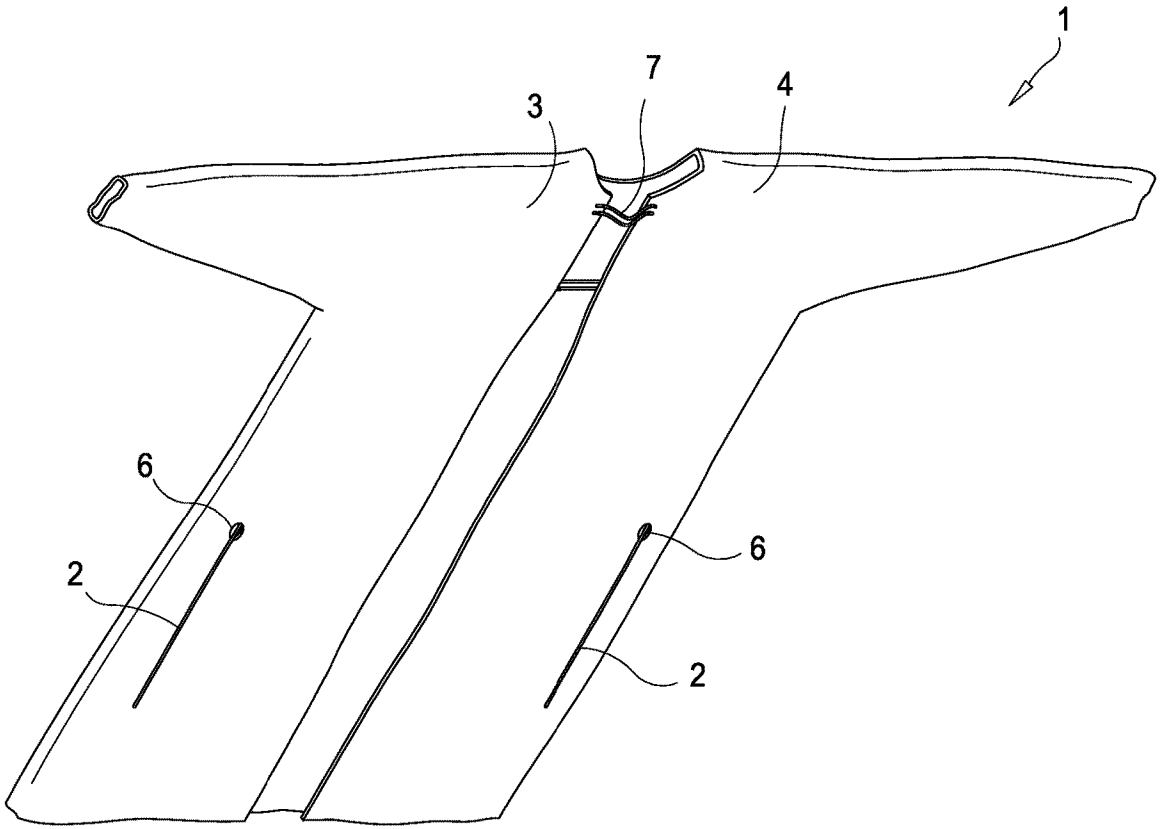
FIG. 2 is a perspective view of the back of the gown.
Figure 3:
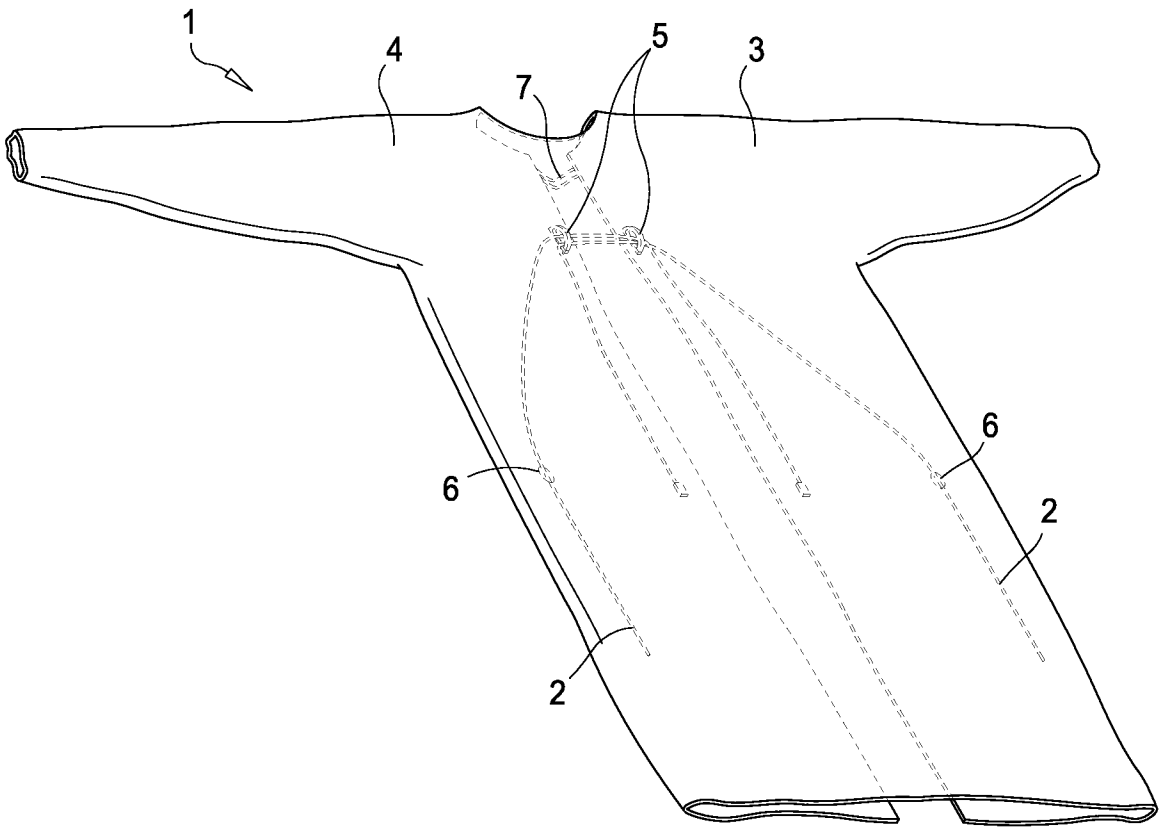
FIG. 3 is a perspective view of the front of the gown with hidden/internal components shown in broken lines.
Figure 4:
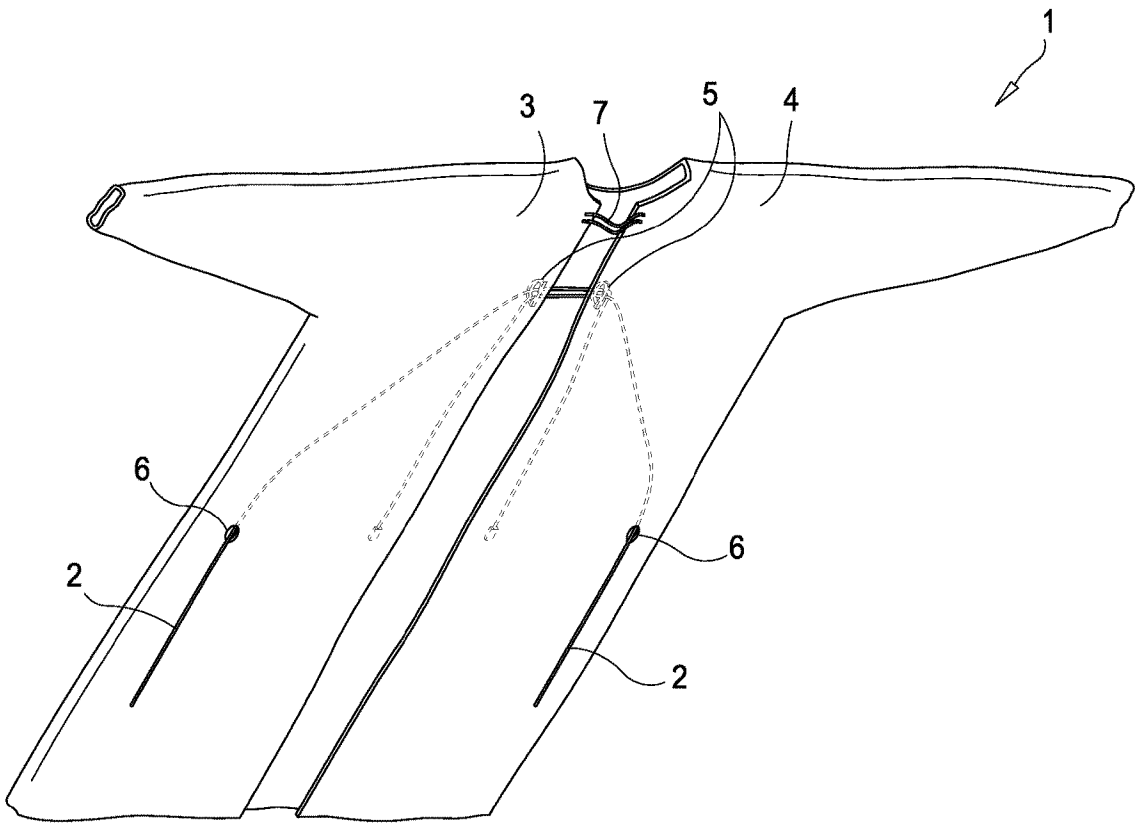
FIG. 4 is a perspective view of the back of the gown with hidden/internal components shown in broken lines.

The described embodiment shown on the figures is a gown 1 intended to be pulled over the user's head and rest on the user's shoulders, said gown 1 having an opening in the back thereof extending from the top portion near the user's shoulders, to the bottom portion of the gown below the waste area as shown on the figures. The opening may span the entire length of the gown 1 or only a portion thereof. One or more cords 2 are attached to the interior of the gown 1 on each side of the opening in the rear of the gown 1.

One end of the first cord 2 is securely attached to the interior of the gown 1 on one side 3 of the opening in the back of the gown, at a height corresponding to the waist area of the user. One end of the second cord 2 is attached to the inside of the gown 1, on the other side 4 of the opening, also at a height corresponding to the waist area of the user.

A means to temporarily attach the cord to the gown in the shoulder area is provided. Each cord is temporarily attached to the gown in the top portion thereof, preferably near the shoulder of the user, at a minimum of one location. The cord can be temporarily attached to the top area of the gown using a variety of well-known temporary attachment methods such as a loop through which the cord is passed, hook and loop design, adhesives, and magnets. The choice of which method is to be used to temporarily attached the cord to the gown may depend on whether the gown is disposable or reusable.

Figure 5:
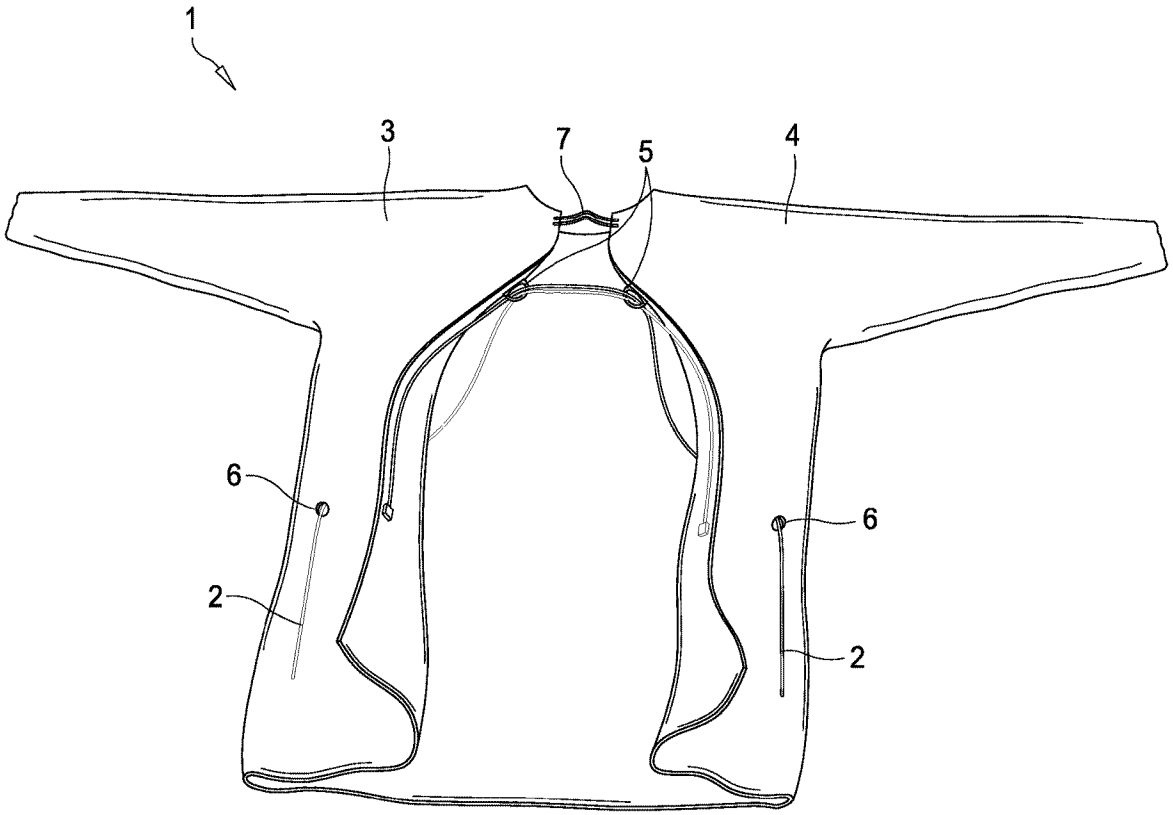
FIG. 5 is the back of the gown with internal components exposed.
Figure 7:
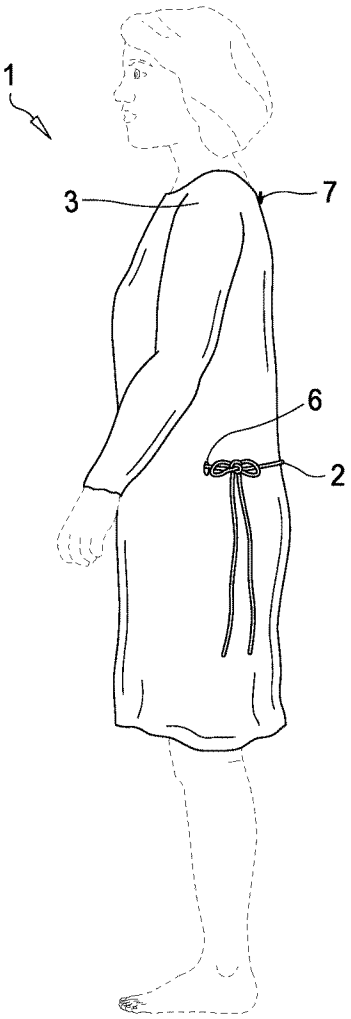
FIG. 7 is a side view of the gown when placed on the user.
Figure 6:
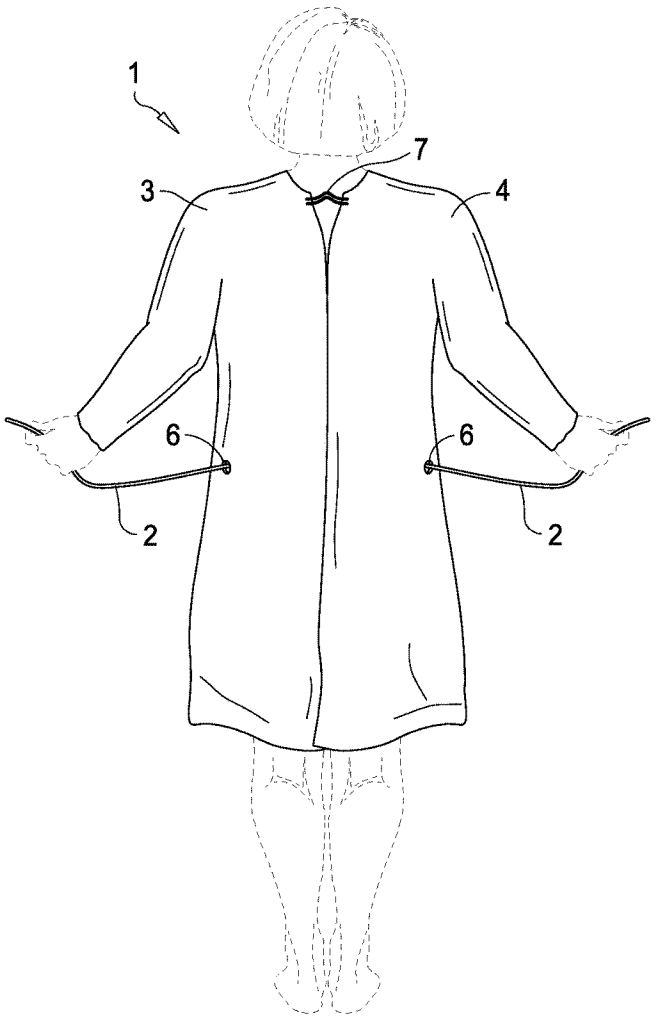
FIG. 6 is the back of the gown when placed on the user.

FIG. 5 shows the use of a loop 5 secured to the interior of each side of the gown 1. The loops 5 are positioned in the top area of the gown 1, just inside the opening. The loop 5 may be oriented either vertically or horizontally. One or more ends of the loop 5 are secured in such a manner that it may be easily detached from the gown 1. As shown in FIG. 5, each cord 2 runs upwards along the inside edge of the opening on the same side of the gown 1 to which they originate. The cords 2 are then attached to the gown as described above, such as by passing through the loop 5 that is on the same side of the gown 1 from which that cord 2 originates.

Each cord 2 then passes through the loop 5 on the side of the gown 1 opposite the side from which that particular cord 2 originates. The cords 2 are then passed through holes 6 in the gown 1, which are positioned near the side of the gown 1 and at the approximate height of the waist of the user. The cords 2 are passed through the hole 6 that is on the opposite side of the gown 1 from which that particular cord 2 originates.

Figure 8:
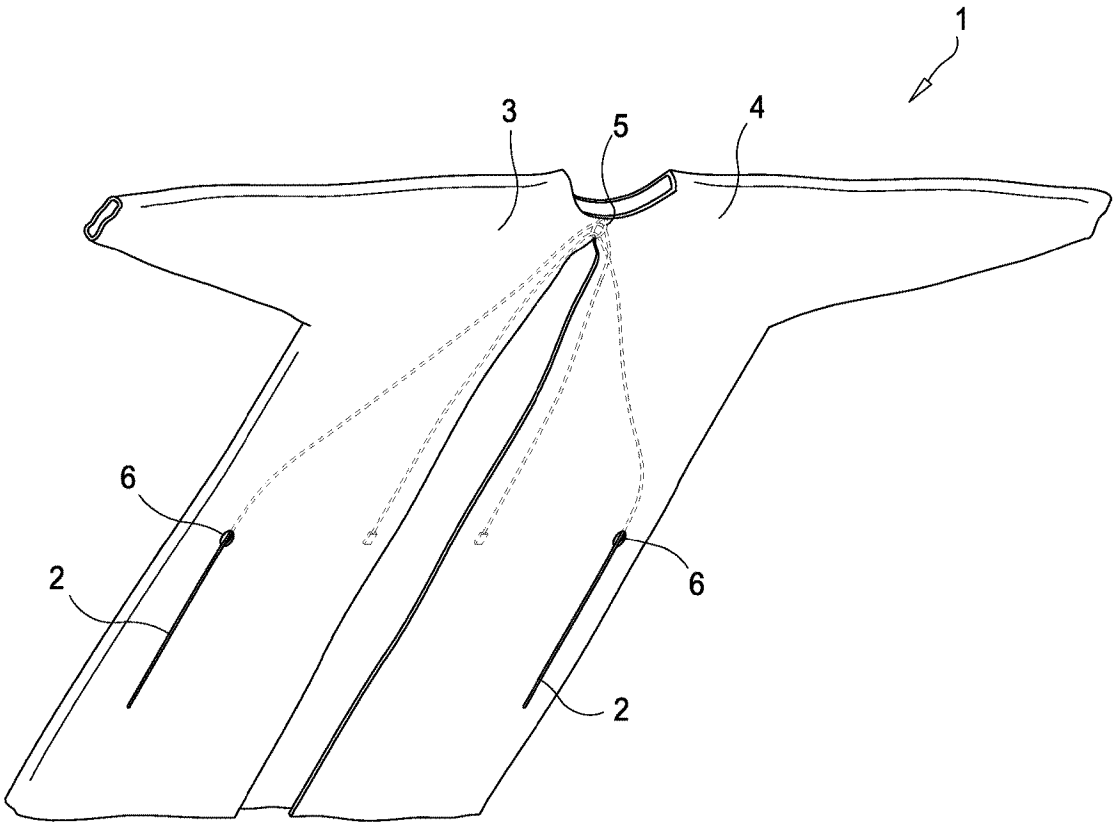
FIG. 8 is the back of a second embodiment of the gown having an opening that starts below the neck/head opening, with internal components exposed.

In another embodiment, shown in FIG. 8, the opening in the back of the gown 1 begins below the neck opening and extends the remaining length of the gown 1. Each cord 2 is temporarily attached to the gown 1 at only one location, just above the opening. For example, each cord 2 passes through one loop 5 instead of two. In this embodiment, one end of the first cord 2 is secured to the interior of the gown 1, on one side 3 of the opening, at a height corresponding to the waist area of the user. The end of the second cord 2 is attached to the inside of the gown 1, on the other side 4 of the opening, also at a height corresponding to the waist area of the user. The cords 2 run upwards along the inside edge of the opening on the same side of the gown 1 from which that particular cord 2 originates. The cords 2 are passed through the single loop 5 at the top of the gown 1. The cords 2 are then passed through holes 6 in the gown 1, which are positioned near the side of the gown 1 and in the waist area of the user. The cords 2 are passed through the hole 6 that is on the opposite the side of the gown 1 from which they originate.

Thus in one embodiment the gown is created with the following features

- an opening for a user's head in a top portion in the shoulder area, a bottom portion, front portion, and a back portion;
- two arm openings;
- an opening in the back portion extending from the opening for a user's head in the top portion to the bottom portion and creating a left side and a right side of the back portion;
- a first cord, having two ends, with one end terminated and securely permanently attached to an inside surface at an edge area of the gown opening in the back portion of the left side of the gown opening in the back portion in an area designed to be a waist area of a user, the first cord further extending along an edge area of the gown opening in the back portion to the shoulder area in the top portion where a temporary secured attachment at an edge area of the gown opening in the back portion is provided for the first cord in at least one location, said first cord traversing from the left side of the gown opening in the back portion to the right side of the gown opening in the back portion where a temporary secured attachment in an edge area of the gown opening in the back portion is provided for the first cord in at least one location, and further extending to the waist area and passes through a hole in an inner surface on the right side of the gown opening in the back portion extending to an outer portion of the gown;

a second cord, having two ends, with one end terminated and securely permanently attached to an inside surface of the right side of the gown opening in the back portion in an area designed to be the waist area of the user, the second cord further extending along an edge area of the gown opening in the back portion to the shoulder area in the top portion where a temporary secured attachment at an edge area of the gown opening in the back portion is provided for the second cord in at least one location, said second cord traversing from the right side of the gown opening in the back portion to the left side of the gown opening in the back portion where a temporary secured attachment in an edge area of the gown opening in the back portion is provided for the second cord in at least one location, and further extending to the waist area and passes through a hole in an inner surface on the left side of the gown opening in the back portion extending to an outer portion of the gown.

As previously stated the gown 1 is designed to be pulled down over the head of the user and rest on the user's shoulders. The gown 1 may be closed in the neck area with a hole large enough for a user's head to pass. Alternatively, the opening in the back of the gown 1 may span the entire length of the gown 1 with one or more elastic/stretchable strips 7 utilized to secure two sides of the back opening together. As shown in FIG. 5, one end of the strip 7 is secured to one side 3 of the opening in the back of the gown with the second end of the strip 7 attached to the other side of the opening in the gown 1. If included, the elastic strip(s) 7 is located on the upper portion of the gown 1 near the neck/shoulder area, as shown in FIG. 5.

The material of the gown 1 can be varied as warranted by the intended use and the intended user. Thus the gown 1 can be disposable or reusable. They gown 1 may also be made of a breathable material.

In the proposed method of use the gown 1 is placed over the head of the user and rests on the user's shoulders. The user pulls downwards on the cords 2, thereby separating the attachment cords from their temporary attachment to the gown 1. The cords 2 are then pulled towards the front or one side of the user until the back of the gown 1 is closed. The cords 2 may then be tied together in the front or side of the gown 1.

Numerous embodiments are envisioned by this invention. I also include gowns used in other applications besides medical such as food preparation, chemical testing and industrial clean rooms.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

The invention claimed is:

1. A gown comprising:

a head opening in a top portion in a shoulder area, a bottom portion, a front portion, and a back portion;

two arm openings;

a gown opening in the back portion extending from the head opening in the top portion through the bottom portion and creating a left side and a right side of the back portion;

a first cord, having two ends, one end terminating and securely, permanently attached to an inside surface at an edge area of the gown opening in the back portion on the left side in an area intended to be a waist area for a user, the first cord further extending along the edge area of the gown opening in the back portion to the shoulder area in the top portion where a temporary secured attachment at the edge area of the gown opening in the back portion is provided for the first cord directly above the terminating end of the first cord, the first cord traversing from the temporary secured attachment on the left side of the gown opening in the back portion to the right side of gown opening in the back portion and further extending to the waist area and passes through a hole in an inside surface on the right side of the gown opening in the back portion and extending to an outside surface of the gown; and a second cord, having two ends, one end terminating and securely, permanently attached to the inside surface at an edge area of the gown opening in the back portion on the right side in the area intended to be a waist area for a user, the second cord further extending along the edge area of the town opening in the back portion to the shoulder area in the top portion where a temporary secured attachment at the edge area of the gown opening in the back portion is provided for the second cord directly above the terminating end of the second cord, the second cord traversing from the temporary secured attachment on the right side of the gown opening in the back portion to the left side of the gown opening in the back portion and further extending to the waist area and passes through a hole in an inside surface on the left side of the gown opening in the back portion and extending to an outside surface of the gown.

2. The gown according to claim 1 wherein the gown is made of a breathable material.

3. The gown according to claim 1 wherein at least one elastic strip, positioned in the shoulder area of a user, traverses the gown opening and is permanently attached to the right side portion and to the left side portion of the back of the gown on each side of the gown opening.

4. The gown according to claim 3 wherein the gown is made of a breathable material.

5. The gown according to claim 1 wherein the first cord and the second cord are temporarily attached to the top portion of the gown utilizing a loop for the temporary secured attachment.

6. The gown according to claim/wherein sleeves are attached to the arm openings.

7. The gown according to claim 1 wherein sleeves are attached to the arm openings.

8. The gown according to claim 1 wherein the first cord and the second cord are temporarily attached to the top portion of the gown utilizing a hook and loop device for the temporary secured attachment.

9. The gown according to claim 8 wherein sleeves are attached to the arm openings.

10. The gown according to claim 3 wherein the first cord and the second cord are temporarily attached at the top portion of the gown using hook and loop devices for the temporary secured attachment located in the shoulder area of the left and right side portions of the back portion of the gown.

11. The gown according to claim 1 wherein the first cord and the second cord are temporarily attached to the top portion of the gown utilizing an adhesive for the temporary secured attachment.

12. A gown comprising:

ahead opening in a top portion in a shoulder area, a bottom portion, a front portion, and a back portion;

two arm openings;

a gown opening in the back portion extending from the head opening in the top portion through the bottom portion and creating a left side and a right side of the back portion;

a first cord, having two ends, one end terminating and securely, permanently attached to an inside surface at an edge area of the gown opening in the back portion on the left side in an area intended to be a waist area for a user, the first cord further extending along the edge area of the gown opening in the back portion to the shoulder area in the top portion where a temporary secured attachment at the edge area of the gown opening in the back portion is provided for the first cord directly above the terminating end of the first cord, the first cord further extending to traverse from the temporary secured attachment on the left side of the gown opening in the back portion to the right side of the gown opening in the back portion where a temporary secured attachment along the edge area of the town opening in the back portion is provided for the first cord in at least one location, the first cord further extending to the waist area and passes through a hole in an inside surface on the right side of the gown opening in the back portion and extending to an outside surface of the gown; and a second cord, having two ends, one end terminating and securely, permanently attached to an inside surface at an edge of the town opening in the back portion on the right side in an area intended to be a waist area for a user, the second cord further extending along the edge area of the town opening in the back portion to the shoulder area in the top portion where a temporary secured attachment at the edge area of the gown opening in the back portion is provided for the second cord directly above the terminating end of the second cord, the second cord further extending to traverse from the temporary secured attachment on the right side of the gown opening in the back portion to the left side of the gown opening in the back portion where a temporary secured attachment is provided for the second cord along the edge area, the second cord further extending to the waist area and passes through a hole in an inside surface on the left side of the gown opening in the back portion and extending to an outside surface of the gown.

13. The gown according to claim 12 wherein the gown is made of a breathable material and sleeves are attached to the arm openings.

14. The gown according to claim 12 wherein at least one elastic strip, positioned in the shoulder area of a user, traverses the opening and is permanently attached to the right side portion and to the left side portion of the back of the gown on each side of the gown opening.

15. The gown according to claim 12 wherein the first cord and the second cord are temporarily attached to the top portion of the gown utilizing a hook and loop device for the temporary secured attachment on each side of the gown opening.

16. The gown according to claim 14 wherein the first cord and the second cord are temporarily attached to the top portion of the gown by passing the first cord and the second cord through a loop located at the top portion of the gown, wherein at least one end of the loop is temporarily attached to the gown.

17. The gown according to claim 12 wherein the first cord and the second cord are temporarily attached at the top portion of the gown utilizing a loop for the temporary secured attachment located in the shoulder area of the left and right side portions of the back portion of the gown.

18. A gown comprising:

a head opening in a top portion in a shoulder area, a bottom portion, a front portion, and a back portion;

two arm openings;

a gown opening in the back portion extending from below the head opening in the top portion through the bottom portion and creating a left side and a right side of the back portion;

a first cord, having two ends, one end terminating and securely, permanently attached at an edge area of the gown opening in the back portion to an inside surface on the left side in an area intended to be a waist area for a user the first cord further extending along the edge area of the gown opening in the back portion to a temporary secured attachment provided at the edge area of the gown opening in the back portion located in a shoulder area directly above the terminated end of the first cord, the first cord further extending to traverse from the temporary secured attachment on the left side of the gown opening in the back portion to the right side of the gown opening in the back portion further extending to the waist area and passes through a hole in an inside surface on the right side of the gown opening in the back portion and extending to an outside surface of the gown; and a second cord, having two ends, one end terminating and securely, permanently attached at an edge area of the gown opening in the back portion to an inside surface on the right side in an area intended to be a waist area for a user, the second cord further extending along the edge area of the gown opening in the back portion to a temporary secured attachment provided at the edge area of the gown opening in the back portion located in a shoulder area directly above the terminated end of the second cord, the second cord further extending to traverse from the temporary secured attachment on the right side of the gown opening in the back portion to the left side of the gown opening in the back portion further extending to the waist area and passes through a hole in an inside surface on the left side of the gown opening in the back portion and extending to an outside surface of the gown.

19. The gown according to claim 18 wherein the first cord and the second cord traverse the gown opening in the back portion in the shoulder area adjacent to each other.

20. The gown according to claim 1 wherein the first cord and the second cord traverse the gown opening in the back portion in the shoulder area adjacent to each other.

21. The gown according to claim 12 wherein the first cord and the second cord traverse the gown opening in the back portion in the shoulder area adjacent to each other.

22. The gown according to claim 12 wherein the first cord and second cord are temporarily attached to the two locations at the top portion of the gown utilizing an adhesive for the temporary secured attachment.

23. The gown according to claim 14 wherein the first cord and the second cord are temporarily attached to the two locations at the top portion of the gown utilizing an adhesive for the temporary secured attachment.

* * * * *